United States Patent [19]

Labrum

[11] 4,151,584

[45] Apr. 24, 1979

[54] LIGHT-COLLECTING REFLECTOR

[75] Inventor: Joseph H. Labrum, West Jordan, Utah

[73] Assignee: Electro Controls Inc., Salt Lake City, Utah

[21] Appl. No.: 777,447

[22] Filed: Mar. 14, 1977

[51] Int. Cl.[2] ..... F21V 13/04

[52] U.S. Cl. ..... 362/302; 362/373

[58] Field of Search ..... 362/297, 298, 302, 304, 362/305, 350, 373, 215, 264, 268, 346; 350/184, 255, 291, 171, 154, 155, 163, 290

[56] References Cited

U.S. PATENT DOCUMENTS

| | | | |
|---|---|---|---|
| 953,879 | 4/1910 | Williams | 350/184 |
| 981,290 | 1/1911 | Lebby | 362/297 |
| 1,463,623 | 7/1923 | McCarthy | 362/302 |
| 1,651,493 | 12/1927 | Warmisham | 350/184 |
| 1,883,360 | 10/1932 | Fortney | 362/298 |
| 2,110,590 | 3/1938 | Cook, Jr. | 362/297 |
| 2,352,976 | 7/1944 | Schaefer | 350/171 |
| 2,771,001 | 11/1956 | Gretener | 363/264 |
| 3,020,390 | 2/1962 | Lusk | 362/268 |
| 3,116,022 | 12/1963 | Davis | 362/294 |
| 3,704,928 | 12/1972 | Coombs et al. | 362/804 |
| 4,027,944 | 6/1977 | Gottlieb | 362/268 X |

*Primary Examiner*—William M. Shoop
*Assistant Examiner*—Peter S. Wong
*Attorney, Agent, or Firm*—Mallinckrodt & Mallinckrodt

[57] ABSTRACT

A light-collecting reflector for use with a source of light comprises a main reflector having a central parabolic reflecting surface and an outer ellipsoidal reflecting surface surrounding the central surface. The main reflector is adapted to have a source of light placed along its central axis. A secondary reflector having a reflecting surface facing the reflector surfaces of the main reflector and having an open central portion to allow light to pass therethrough, is positioned in front of the main reflector so that light striking the reflector surface of the secondary reflector is reflected back toward the reflecting surfaces of the main reflector. The reflecting surface of the secondary reflector is arcuate with radii that emanate from a circle which is concentric with the center axis of the main reflector.

15 Claims, 1 Drawing Figure

LIGHT-COLLECTING REFLECTOR

BACKGROUND OF THE INVENTION

1. Field

The invention is in the field of light collecting reflectors for use with sources of light, the reflectors being adapted to direct light from a light source as a directional light beam.

2. State of the Art

Numerous reflectors have been devised for directing light from a light source as a directional beam of light. The most common reflectors in use today, particularly in the stage lighting and projection fields, utilize a reflecting surface which is a portion of an ellipse. The light source is located at the focus of the ellipse. The so-called ellipsoidal reflector has two major disadvantages. The first is that the majority of the light energy in a projected beam from such a reflector is concentrated in the center portion of the beam. This means that the center of the beam is brighter than the outer portion, resulting in uneven illumination. This concentration of energy in the center of the beam causes the center to contain more heat than the rest of the beam. The concentration of heat in the center can easily damage color media used with the light.

The second disadvantage of the ellipsoidal reflector is that its collection efficiency is only somewhere between 25 and 35 percent. This means that only 25 to 35 percent of the light given off by the light source ends up in the projected beam of light.

Reflecting surfaces utilizing other geometric shapes, such as portions of parabolas or spheres, have been used as well as have been various combinations of various geometric shapes. However, the shapes and combinations of shapes that have been used all leave room for improvement in both the light collection efficiency of the reflectors and in the uniform distribution of light intensity over the cross-section of a light beam projected by such reflectors. None of these reflectors have so far replaced the ellipsoidal reflector for general use in light projection equipment such as stage-lighting spotlights.

3. Objective

It was a principal objective of the invention to provide a light collecting reflector which produces an improved, substantially uniform, light distribution over the cross-section of a projected light beam, to provide a light collecting reflector with improved light collection efficiency, and to achieve these objectives with a reflector economical enough to replace the standard ellipsoidal reflector in a majority of applications.

SUMMARY OF THE INVENTION

According to the invention, a light-collecting reflector comprises a main reflector and a secondary reflector. The central portion of the reflecting surface of the main reflector is parabolic in shape and is surrounded by an outer ellipsoidal reflecting surface. The reflector is adapted to have a source of light placed along the central axis of the main reflector. The secondary reflector, which has an open central portion to allow light to pass therethrough, is positioned in front of the main reflector and has an arcuate reflecting surface with the radii of the arcs emanating from a circle whose center is located on the central axis of the main reflector. Light striking the secondary reflector surface is reflected back toward the reflecting surfaces of the main reflector to be reflected with the beam of light passing through the open central portion of the secondary reflector.

The reflector is particularly useful in stage lighting spotlights and in such instances will generally be mounted in a housing which includes means for mounting the light source along the central axis of the reflector. The housing will also generally include a lens system and a framing gate located between the reflector and lens system. The framing gate has an opening therethrough to allow passage of light from the reflector. The lens system focuses onto the stage the light beam which passes through the framing gate opening. Although a framing gate in addition to the reflector is preferred, in some instances the framing gate will be unnecessary because the central opening in the secondary reflector can serve the same purpose.

THE DRAWING

In the accompanying drawing which represents the best mode presently contemplated of carrying out the invention, FIG. 1 is a schematic representation of a section of a preferred stage spotlight incorporating the light-collecting reflector of the invention and showing the light source and its associated supporting socket in elevation.

DETAILED DESCRIPTION OF THE ILLUSTRATED EMBODIMENT

Figure 1:
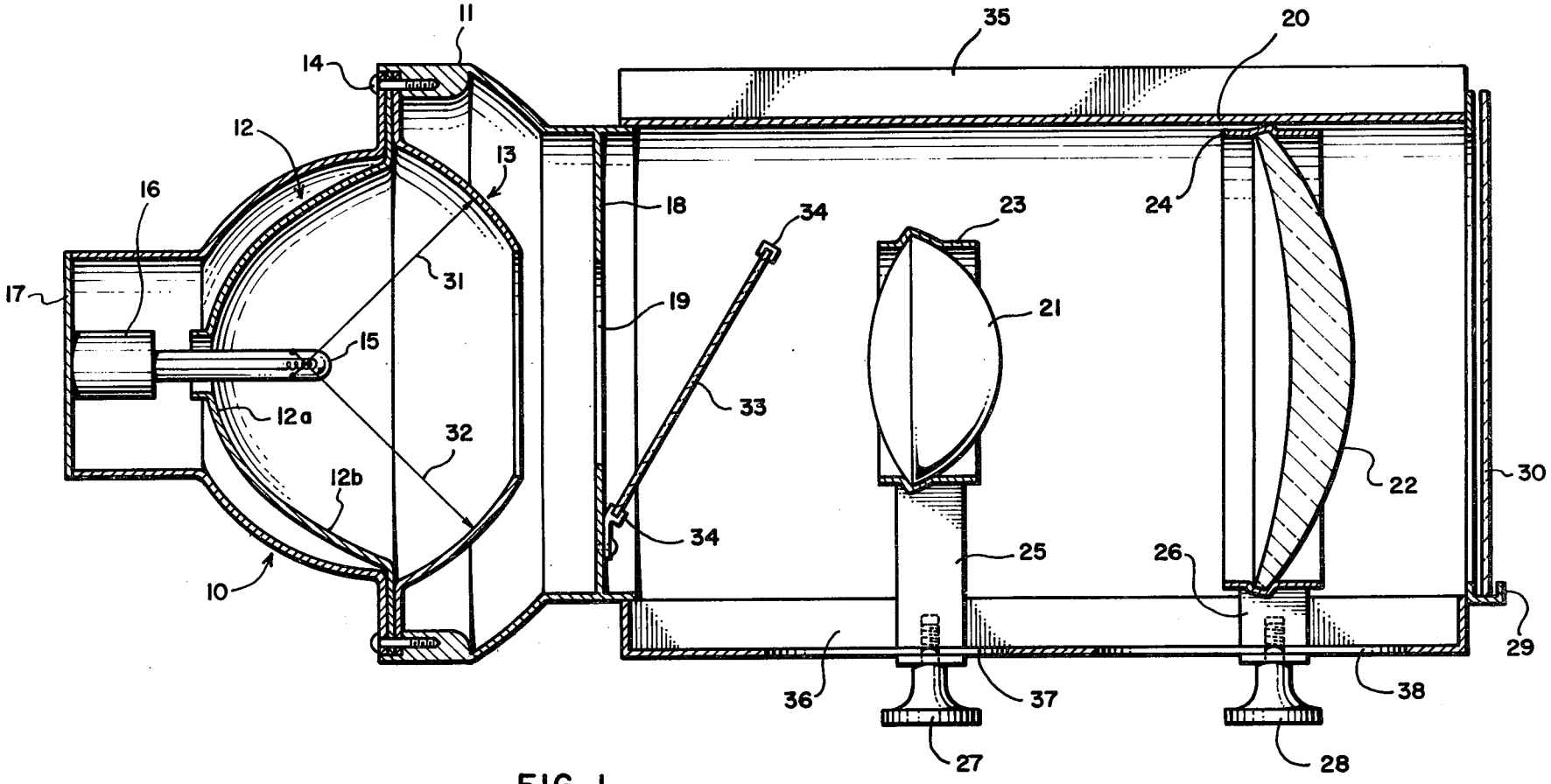
Figure 1:
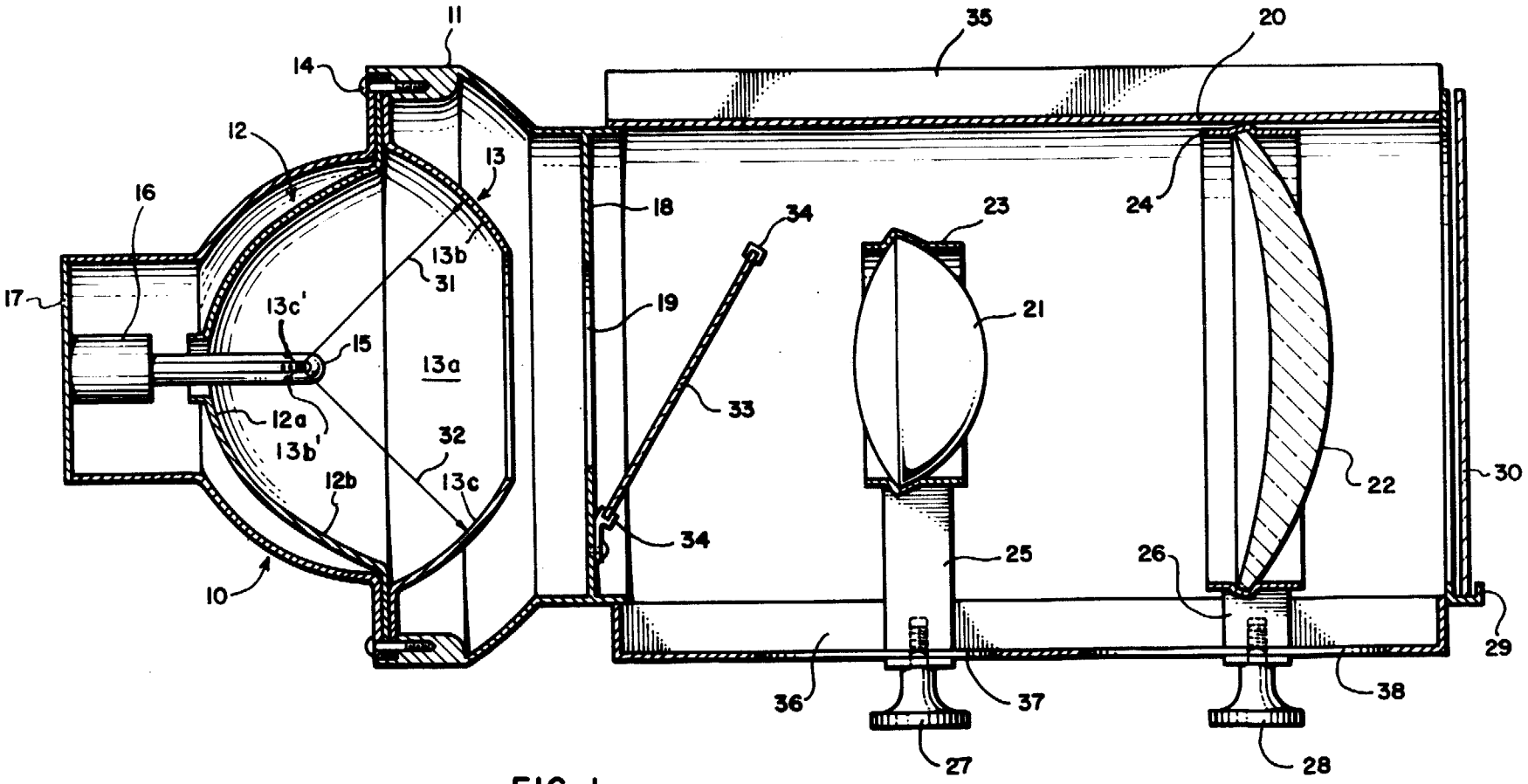

As illustrated, a spotlight particularly adapted for stage lighting purposes has a rear supporting body 10 and central supporting body 11. The rear supporting body 10, along with a main reflector 12 and secondary reflector 13, is attached to the central supporting body 11 by screws 14.

A source of light 15 is positioned along the central axis of the reflector, and is plugged in and supported by a socket 16 attached to rear supporting body 10 in any suitable manner, such as by plate 17, so that the light source 15 may be removed and replaced as needed. Tungsten halogen light sources have been found satisfactory for use. The light source may conveniently be a bulb such as made by Sylvania and others having a medium, prefocus, lamp base with a CC-8 filament.

A framing gate 18, with framing gate opening 19, is cast as an integral part of central support body 11, but, of course, could be a separate piece secured to support body 11 in any suitable manner.

A forward support body 20 is secured to central support body 11 in any suitable manner. Lenses 21 and 22 are held in place by lens holding rings 23 and 24, respectively, which are mounted on supports 25 and 26. Supports 25 and 26 are secured to the forward support body 20 by hand knobs 27 and 28. The lens system made up of lenses 21 and 22 to focus the light beam passing through framing gate opening 19.

The usual color media holder 29 is attached in suitable manner to the front of the forward support body 20 to hold the usual color media slides 30 when desired to color the projected light.

The main reflector 12 has a central reflecting surface **12*a* which is parabolic in shape and an outer reflecting surface 12*b*** peripherally surrounding the central reflecting surface and ellipsoidal in shape. The parabola and ellipse preferably have a common focus.

It has been found that the optimal position for the framing gate is at approximately the position of the minor axis of the ellipse of the outer reflector surface **12*b***.

There is no fixed optimal relationship between sizes of the various parts of the reflector. The optimum sizes will vary according to the size of the framing gate opening, the focal length of the lens system, and the filament size of the light source. In designing a reflector system according to the invention, the desired distance from the light to the stage is generally known and the desired size of the image on the stage is generally known. With this information the effective focal length and F number of the lens system can be determined, keeping in mind that experience has shown that the lens system should have an F number of at least one to give satisfactory light collection efficiency. Experience has also shown that a framing gate opening of about 80 millimeter diameter is satisfactory. The focal length of the lens system gives the distance of the lens system from the framing gate.

In order to preserve any color media that may be used, it is desirable to have the image of the light source filament as imaged by the lens system about one foot or more beyond the color media. Thus, knowing the focal length of the lens system, the rearmost limit for placement of the filament is thereby established.

A ray trace of light rays leaving the light source may now be made to determine the optimum size of the main reflector. The size is chosen so that the maximum number of light rays pass through the framing gate and enter the lens system.

The optimum dividing line between the parabolic and ellipsoidal portions of the reflector, under conditions mentioned above and where the common focus of the parabola and ellipse are located along the central axis of the reflector, may be located approximately by extending a line through the focus of the ellipse toward the apex of the reflector and at an angle of 60° from the central axis of the reflector. If the parabolic section of the reflector extends substantially farther than the intersection of the 60° line with the ellipse, it has been found generally that significant amounts of light are reflected from this extended parabolic surface in such a way that they become trapped and do not leave the reflector in a useable manner. This reduces the light collection efficiency. If the parabolic section of the reflector extends substantially less than the intersection of the 60° line, it has been found generally that the light becomes more concentrated in the center of the light beam. The concentration in the center of the beam increases as the parabolic reflecting surface gets smaller.

Although 60° is a good median value based upon the framing gate size and light source mentioned, with other framing gate sizes and light source sizes and types, the value may drop to as little as approximately 30° or may increase beyond the 60° to as great as approximately 75°. Generally, a larger filament and larger reflector (increase in reflector size is not same percent increase as filament size) with constant framing gate opening size, would require the parabolic central section of the reflector to be reduced below 60°.

The optimum extent of the ellipsoidal portion of the reflector surface has been found generally to be about the intersection of the surface with a line drawn through the focus of the ellipse at an angle of 120° to the reflector's central axis. Again, this is subject to variation as is the 60° mentioned above. Generally, if the ellipse extends substantially beyond the 120° line, the light striking that extended portion of the ellipse becomes trapped and does not leave the reflector in a useable manner.

The ideal light source for a system of this type is a point source located at the focus of the ellipse. All known light sources, however, have a finite length over which light is emitted. The optimum position of the light source 13 along the central axis of the reflector and relative to the focus of the reflector system may be approximated as a function of the square of the eccentricity factor of the ellipse. For example, if the eccentricity of the ellipsoidal portion of the reflector is 0.8, the square is 0.64, the light source should be located so that approximately 64 percent of the light emitting portion of the filament is between the focus of the ellipse and the center. The remaining portion, or approximately 36 percent, will be between the focus of the ellipse and the apex.

It has been found preferable that rather than placing the common focus of the parabola and ellipse right on the central axis of reflector, as would be desirable for a point light source, that when using a light source with filament thickness, the reflector be a composite formation of an infinite number of parabolic and ellipsoidal slices, the parabolic and ellipsoidal portions of each slice preferably having a common focus, the focus of each slice being located slightly off the central axis of the reflector so that the foci of such slices form a circle about the central axis. The distance off the axis is preferably equal to the radius of the filament. In this way, the foci are located right on the edge of the filament and form a circle with center along the central axis of the reflector and with a radius equal to the radius of the filament of the light source. Not only does the placement of the foci off axis improve the light collection efficiency of the reflector, but it desensitizes the reflector to some extent so that small errors such as flat spots, etc., in the reflecting surface of the reflector have a minimal effect on the efficiency of light collection. The effect of those errors has been found to be much less with the foci off axis than with a single focus located on the axis.

When the foci of the reflecting portions of the main reflector are moved off axis as described, the optimum value of the dividing line between the parabolic and ellipsoidal portions of the reflector becomes defined by a line through the axis at approximately 50° rather than the 60° mentioned previously. This is because the total diameter of the parabolic portion of the reflector should remain about the same resulting in the junction between the parabolic and ellipsoidal portions being located somewhat farther back toward the apex of the reflector than otherwise.

The combination of the parabolic and ellipsoidal reflecting surfaces as described above for the main reflector 12 has been found to result in greatly improved light distribution over the entire cross-section of the projected light beam. While the pure ellipsoidal reflector tends to produce a light beam which is much brighter at its center than at other parts thereof, the reflector of the present invention gives a fairly uniform distribution of light intensity over the entire light beam.

Since a significant amount of light leaves the light source at angles between those necessary to impinge on the main reflector 12 and those necessary for the light to exit directly through the framing gate opening 19, provision is made by means of a secondary reflector to redirect this light back to the main reflector to be then directed out through the framing gate opening.

The secondary reflector 13 has a composite arcuate reflecting surface **13*a*, in that it is made up of an infinite number of arcs, as at 13***b* and 13*c*, each having a radius emanating from a center, as at 13*b'* and 13*c'*, located on a circle having its center on the central axis of the main reflector 12. Thus, the arcs 13*b* and 13*c* have radii 31 and 32, respectively. In this way the light striking the secondary reflector is reflected back into the main reflector near the common foci of the ellipse and parabola but does not pass directly through the foci. It is preferred that the reflected light not pass through the foci, or through a point on the central axis along the length of the filament as would happen if the secondary reflector were a portion of a sphere with its center being on the central axis along the length of the filament, because such light, when reflected, returns to the filament of the light source and tends to cause localized heating of parts of the filament, shortening filament life. With the center for each arc being away from the foci and away from the central axis, the additional heating of the filament is minimized while still maintaining a high degree of collection efficiency.

The placement and size of th secondary reflector is determined so that the maximum amount of lost light is reflected back into the main reflector in such a way that it is then re-reflected out through the framing gate opening 19. A satisfactory position for the circle from which the radii of the arcs emanate has been found to be slightly behind the foci and with a radius equal to the diameter of the filament. This, of course, may vary as do other aspects of the reflector.

Typical dimensions for the reflector as illustrated in the drawing which is designed for use with an 80 mm framing gate opening and one kilowatt light source are approximately a two-inch diameter at the junction of the parabolic and ellipsoidal portions of the reflector, a six-inch diameter at the forward end of the ellipsoidal reflector, and a six and one-quarter-inch diameter at the edge of the secondary reflector adjacent the main reflector.

With the reflector construction as illustrated and described, it is possible to obtain collection efficiencies of up to about 45 percent. Compared to the maximum efficiencies of between 25 and 35 percent for the standard ellipsoidal reflector, this represents an increase in efficiency of about one-third, and represents a significant increase in light output.

The reflector, as described, can be used in any type of light system. The preferred light system shown includes several other features.

As illustrated, a dichroic or so-called "hot" mirror 33 is attached by holder 34 to framing gate 18. This type of mirror is designed to pass light in the visible range but to reflect infrared energy. Most of the heat content of a light beam is due to the infrared energy contained in the beam. By removing most of the infrared energy from the projected light beam, most of the heat is removed and the light becomes much more comfortable to work in.

Hot mirror 33 is placed at an angle to the light beam coming through framing gate opening 19. The visible portion of the light beam passes through the mirror to the lens system. The infrared portion of the light beam is reflected by the mirror upwardly and back so it strikes either the framing gate 18 or the forward support body 20. Framing gate 18 has a reflective surface so that the infrared energy striking it is reflected to forward support body 20. The surface of forward support body 20 which is in the path of the infrared energy is coated with a non-reflective surface which absorbs such energy. Support body 20, as well as framing gate 18 and central support body 11, is preferably made of aluminum. Forward support body 20 has a series of fins 35 radiating outwardly therefrom to act as cooling surfaces. Because of the present state of the art in the making of dichroic mirrors, the mirror should be at an angle of not more than 30° to the light beam. This means that a small portion of the infrared energy will be reflected back into the light reflectors 12 and 13, but it has been found that this portion is small and does not cause appreciable heating of the reflector.

The lens system illustrated comprises a non-symetrical, bi-convex lens 21 and a meniscus lens 22. Both lenses may be made of the same type of glass. This combination of lenses has been found to greatly reduce the abberations that occur in the currently used lens systems for stage lighting.

As described, the lenses and their holding rings, 23 and 24 respectively are supported by lens supports 25 and 26 respectively. Forward support body 20 has a channel 36 formed therein into which ends of supports 25 and 26 fit. The supports are slidable within this channel. Hand knobs 27 and 28 tighten supports 25 and 26 respectively to the bottom of channel 36. When the hand knobs are loosened, the supports may be slid forwardly or backwardly in the channel to the extent of slots 37 and 38 through which hand knobs 27 and 28 extend.

The movement of lens 21 focuses the light beam while movement of lens 22 makes the lens system a zoom system capable of changing the size of the projected beam image. The zoom range of the system is approximately 1.5 to 1.

In the system illustrated, lens 22 has a typical diameter of 180 mm and lens 21 has a typical diameter of 130 mm.

Whereas this invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A light-collecting reflector for use with a source of light, comprising a main reflector having a central parabolic reflecting surface and an outer ellipsoidal reflecting surface and adapted to have a source of light placed along its central axis, said parabolic reflecting surface and said ellipsoidal reflecting surface being joined along their mathematical intersection; and a secondary reflector having a composite arcuate reflecting surface facing said reflector surfaces of the main reflector and having an open central portion to allow light to pass therethrough, said composite arcuate reflector surface of the secondary reflector having radii that emanate from respective centers located on a circle whose center lies on the central axis of the main reflector, the radii extending from the reflector surface to the circle on the opposite side of the central axis from the respective parts of the reflection surface concerned, so that light striking the reflector surface of the secondary reflector is reflected back toward the reflecting surfaces of the main reflector.

2. A light-collecting reflector according to claim 1, wherein the central parabolic reflecting surface and the outer ellipsoidal reflecting surface have a common focus located on the central axis of the reflector.

3. A light-collecting reflector according to claim 2, wherein the intersection of the parabolic and ellipsoidal surfaces of the reflector occurs behind the common focus.

4. A light-collecting reflector according to claim 1, wherein the central parabolic reflecting surface is of composite formation having foci and the outer ellipsoidal reflecting surface is also of composite formation having foci in common with the foci of the central parabolic reflector surface, said foci forming a circle whose center lies on the central axis of the reflector.

5. A light-collecting reflector according to claim 4, wherein the radius of the circle formed by the foci of the ellipsoidal and parabolic reflecting surfaces is equal to the radius of the filament of a light source that is adapted to be placed along the central axis of the reflector.

6. A light-collecting reflector according to claim 1, wherein the outer ellipsoidal reflector and the secondary reflector are arranged so that substantially all light directly from the source and reflected by the ellipsoidal reflector passes through the open central portion of the secondary reflector.

7. A light-collecting reflector according of claim 1, wherein the open central portion of the secondary reflector is at least substantially as large in diameter as the diameter of the main reflector at the intersection of the parabolic and ellipsoidal surfaces.

8. A stage lighting spotlight comprising, a housing; a light-collecting reflector mounted in the housing and having a main reflector with a central parabolic reflecting surface and an outer ellipsoidal reflecting surface and adapted to have a source of light placed along its central axis, said parabolic reflecting surface and said ellipsoidal reflecting surface being joined along their mathematical intersection, and a secondary reflector having a composite arcuate reflecting surface facing said reflector surfaces of the main reflector and having an open central portion to allow light to pass therethrough, said composite arcuate reflecting surface of the secondary reflector having radii that emanate from respective centers located on a circle whose center lies on the central axis of the main reflector, the radii extending from the reflector surface to the circle on the opposite side of the central axis from the respective parts of the reflection surface concerned, so that light striking the reflector surface of the secondary reflector is reflected back toward the reflecting surfaces of the main reflector; and, a lens system mounted in the housing to focus the light passing through the central open portion of the secondary reflector.

9. A spotlight according to claim 8, wherein there is additionally included a framing gate mounted in the housing between the reflector and the lens system and having an opening therein to allow light from the reflector to pass therethrough; and the lens system is adapted to focus the light passing through the opening in the framing gate.

10. A spotlight according to claim 9, wherein the lens system includes a non-symetrical, bit-convex lens, and a meniscus lens, the non-symetrical, bi-convex lens being located between the framing gate and the meniscus lens, and being movable in relation to the framing gate and the meniscus lens, closer to either one or the other, to permit variable focusing of the light beam.

11. A spotlight according to claim 10, wherein the meniscus lens is movable toward or away from the framing gate and the non-symetrical, bi-convex lens to provide zoom capabilities to the lens system.

12. A spotlight according to claim 11, wherein a dichroic mirror is placed between the framing gate and the lens system so that visible light passes through said dichroic mirror but infrared energy is reflected by said mirror to the framing gate and housing which act as heat sinks for such infrared energy.

13. A spotlight according to claim 12, wherein the housing and framing gate are made of a heat-conductive material, and cooling fins are provided on a portion of the housing.

14. A spotlight according to claim 9, wherein a dichroic mirror is placed between the framing gate and the lens system so that visible light passes through said dichroic mirror but infrared energy is reflected by said mirror to the framing gate and housing which act as heat sinks for such infrared energy.

15. A spotlight according to claim 14, wherein the housing and framing gate are made of a heat-conductive material, and cooling fins are provided on a portion of the housing.

* * * * *

UNITED STATES PATENT AND TRADEMARK OFFICE

CERTIFICATE OF CORRECTION

PATENT NO. : 4,151,584

DATED : April 24, 1979

INVENTOR(S) : Joseph H. Labrum

It is certified that error appears in the above-identified patent and that said Letters Patent are hereby corrected as shown below:

Column 2, line 54, after "22" insert --serves--.

Column 5, line 21, "th" should read --the--.

The title page and the sole sheet of drawing should be deleted to insert the attached title page and sheet of drawing.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*

United States Patent [19]

Labrum

[11] 4,151,584

[45] Apr. 24, 1979

[54] LIGHT-COLLECTING REFLECTOR

[75] Inventor: Joseph H. Labrum, West Jordan, Utah

[73] Assignee: Electro Controls Inc., Salt Lake City, Utah

[21] Appl. No.: 777,447

[22] Filed: Mar. 14, 1977

[51] Int. Cl.[2] ..... F21V 13/04

[52] U.S. Cl. ..... 362/302; 362/373

[58] Field of Search ..... 362/297, 298, 302, 304, 362/305, 350, 373, 215, 264, 268, 346; 350/184, 255, 291, 171, 154, 155, 163, 290

[56] References Cited

U.S. PATENT DOCUMENTS

| | | | |
|---|---|---|---|
| 953,879 | 4/1910 | Williams | 350/184 |
| 981,290 | 1/1911 | Lebby | 362/297 |
| 1,463,623 | 7/1923 | McCarthy | 362/302 |
| 1,651,493 | 12/1927 | Warmisham | 350/184 |
| 1,883,360 | 10/1932 | Fortney | 362/298 |
| 2,110,590 | 3/1938 | Cook, Jr. | 362/297 |
| 2,352,976 | 7/1944 | Schaefer | 350/171 |
| 2,771,001 | 11/1956 | Gretener | 363/264 |
| 3,020,390 | 2/1962 | Lusk | 362/268 |
| 3,116,022 | 12/1963 | Davis | 362/294 |
| 3,704,928 | 12/1972 | Coombs et al. | 362/804 |
| 4,027,944 | 6/1977 | Gottlieb | 362/268 X |

*Primary Examiner*—William M. Shoop
*Assistant Examiner*—Peter S. Wong
*Attorney, Agent, or Firm*—Mallinckrodt & Mallinckrodt

[57] ABSTRACT

A light-collecting reflector for use with a source of light comprises a main reflector having a central parabolic reflecting surface and an outer ellipsoidal reflecting surface surrounding the central surface. The main reflector is adapted to have a source of light placed along its central axis. A secondary reflector having a reflecting surface facing the reflector surfaces of the main reflector and having an open central portion to allow light to pass therethrough, is positioned in front of the main reflector so that light striking the reflector surface of the secondary reflector is reflected back toward the reflecting surfaces of the main reflector. The reflecting surface of the secondary reflector is arcuate with radii that emanate from a circle which is concentric with the center axis of the main reflector.

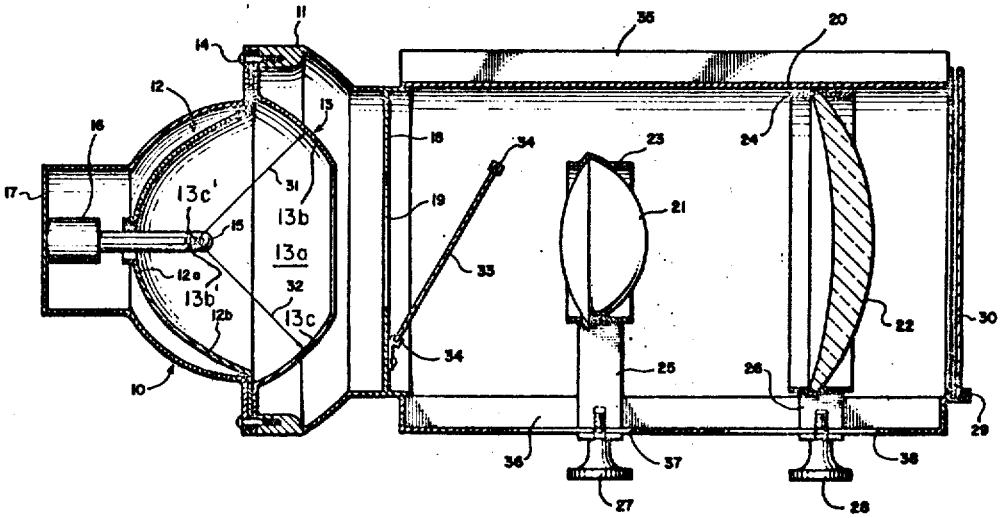

15 Claims, 1 Drawing Figure